US006394361B1

(12) United States Patent
Fridmann et al.

(10) Patent No.: US 6,394,361 B1
(45) Date of Patent: May 28, 2002

(54) DEVICE FOR AUTOMATICALLY BALANCING A LIQUID-BASED HEAT-TRANSFER SYSTEM

(75) Inventors: Pierre Fridmann, Lyons; Jacky Leger, Neuilly L'Hospital; Jean Philippe Robin, Lyons, all of (FR)

(73) Assignee: COMAP, Lyons (FR)

( * ) Notice: Subject to any disclaimer, the term of this patent is extended or adjusted under 35 U.S.C. 154(b) by 0 days.

(21) Appl. No.: 09/830,711

(22) PCT Filed: Nov. 22, 1999

(86) PCT No.: PCT/FR99/02873

§ 371 (c)(1),
(2), (4) Date: Jun. 25, 2001

(87) PCT Pub. No.: WO00/31475

PCT Pub. Date: Jun. 2, 2000

(30) Foreign Application Priority Data

Nov. 25, 1998 (FR) ..... 98 15007

(51) Int. Cl.[7] ..... F24D 3/00
(52) U.S. Cl. ..... 237/8 A; 236/100
(58) Field of Search ..... 237/8 R, 8 A, 237/2 A; 236/100

(56) References Cited

U.S. PATENT DOCUMENTS 3,840,177 A * 10/1974 Osheroff ..... 137/805
4,025,041 A * 5/1977 Tyler ..... 236/90
4,089,461 A * 5/1978 Gocke ..... 236/100
4,288,031 A * 9/1981 Hass ..... 123/41.1
4,410,133 A * 10/1983 Furukubo ..... 236/100
4,535,931 A * 8/1985 Bartok et al. ..... 122/14.2
5,018,665 A * 5/1991 Sulmone ..... 236/100
5,174,496 A * 12/1992 Bourgin ..... 236/34.5

FOREIGN PATENT DOCUMENTS

EP 0 677 708 A2 10/1995
GB 2 184 208 A 6/1987

* cited by examiner

*Primary Examiner*—Harold Joyce
*Assistant Examiner*—Derek S. Boles
(74) *Attorney, Agent, or Firm*—Oliff & Berridge, PLC

(57) ABSTRACT

In a device including a first calibrated or adjustable orifice and a second orifice located downstream of the first orifice, the opening of the second orifice is adjusted by a valve whereof the position is controlled by apparatus displacing the valve depending on the pressure difference prevailing between upstream and downstream of the first orifice and by apparatus producing a displacement depending on the temperature of the premises wherein the device is located. The device is mounted in two separate bodies, mutually linked, a first body corresponding to the first orifice and a second body corresponding to the second orifice. The device enables to produce both automatic hydraulic balancing and thermostatic control.

19 Claims, 6 Drawing Sheets

DEVICE FOR AUTOMATICALLY BALANCING A LIQUID-BASED HEAT-TRANSFER SYSTEM

Figure 1:
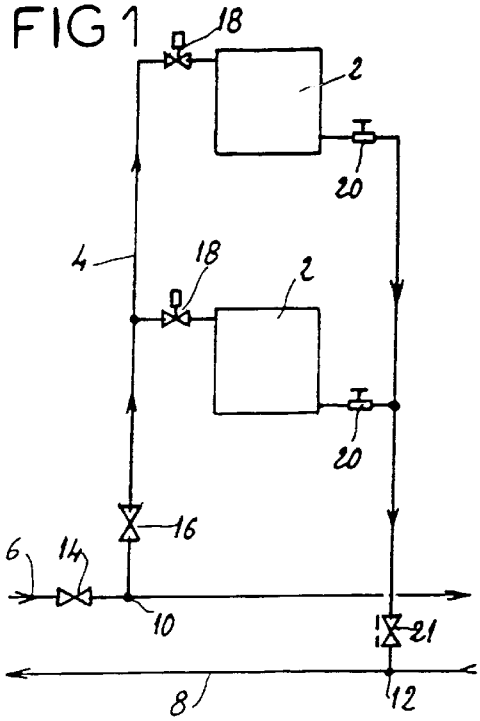

The present invention relates to a device for balancing a liquid-based heat-transfer system for a heating system. Such a system is equipped with a boiler or the like for heating a fluid which is sent by way of pump means to heat emitters, such as radiators, by a network of liquid pipes. The device according to the invention also provides thermostatic regulation of a heat emitter.

The present invention also relates to liquid-based circuits using fan convectors. It is as suitable for heating circuits as for cold-water circuits used for the air-conditioning of rooms. The description that follows is essentially given with reference to heating circuits but it also applies to cooling technology using a cold-water circuit or a circuit of some other fluid.

In a heating system, in addition to the boiler, radiators and pipes, there are also regulating means whose function is to correctly distribute the heat-transfer fluid to the heat emitters and ensure that a sufficient flow is sent through each of them. The heating circuit is balanced in order for the system to run properly. This balancing operation involves regulating the various regulating means in such a way as to obtain flowrates which are worked out beforehand for base conditions selected to suit different parts of the system that are kept permanently on. Admittedly, a system will almost never be kept permanently on, but that in no way detracts from the value of balancing a circuit, because if the flowrates are caused to vary in the course of operation, this must be allowed for at the design stage and, if necessary, differential pressure regulators connected in series or in parallel must be provided. This however has to do with regulation rather than balancing of the system.

There are several balancing devices, also known as balancing means, which enable a heating system to be balanced. These means are designed to regulate the distribution of flows to the various branches of the distribution circuits.

First of all, unadjustable balancing means are known. These are apertures, that is to say fixed calibrated orifices whose diameter is determined for each of them from a knowledge of the desired relationship between flowrate and loss of head. The use of this type of means requires a complete and painstaking hydraulic calculation of all the circuits of the system in order to determine the precise characteristics of each aperture. If there is any mistake in the calculation, the only solution is to change the aperture. This solution, though seemingly relatively inexpensive, is therefore very rarely employed.

To avoid having to change the balancing means in the event of a computational error, there exist adjustable balancing means known as for example lockshield valves or thermostatic radiator valves. These means enable the flowrate through a circuit to be regulated and hence balanced on the basis of prior knowledge of the desired relationship between flowrate and loss of head. This requires a complete hydraulic calculation of the entire heating circuit. These adjustable balancing means enable the regulation to be corrected easily in the event of error.

These balancing devices are inexpensive and very widely used by installers. However, they are rarely adjusted as they should be, largely because the calculations are done insufficiently or not at all. Thus fitted with badly adjusted means, the system is therefore unbalanced.

Also known are adjustable balancing means equipped with a device for measuring the flow. These balancing means are generally equipped with a pressure takeoff designed to make a differential pressure measurement. This measurement can be used to determine the fluid flowrate through the balancing means. Using an electronic differential manometer with a microprocessor, measurements of differential pressure and of flowrate can be taken quickly and easily.

For the installer, this type of balancing means has a very appreciable advantage. The setting of the balancing means can be decided by calculation as with the adjustable balancing means described above, but the adjustment can also be carried out directly in situ based on a knowledge of the desired flowrate alone.

In practice, it is not enough, in most cases, to regulate each of the balancing means in succession in order to obtain the desired flowrates. This is because distribution networks are often prone to hydraulic interference. This phenomenon makes it necessary to carry out several adjustments on each of the balancing means, utilizing for example a method of successive approximations or carrying out a careful balancing procedure which can only be done properly if a work plan is prepared beforehand and carried out rigorously.

These adjustable balancing means with flowrate measuring device therefore enable the system to be balanced correctly provided the balancing procedure is adhered to rigorously. This method is reasonably complicated to carry out and installers would prefer a much simpler method.

Lastly, there are also flow regulators. Such a regulator, fitted at the head of a branch circuit, keeps the flowrate constant whatever pressure fluctuations are generated in the main circuit by the action of the terminal controls of the emitters served by the other branch circuits. Interference caused by the operation of the other branch circuits of the same system are thereby eliminated.

The use of these flow regulators as balancing means has however a major drawback. If the valves of the emitters served by the circuit equipped with a flow regulator decide to partly close themselves to a greater or lesser degree, thereby necessarily reducing the flowrate, the regulator will attempt to oppose this reduction by opening. The regulator therefore functions as an antagonist to hydraulic disturbances downstream of the regulator. The use of these flow regulators is therefore incompatible with, for example, the thermostatic radiator valves which are currently widely used.

Actually, this type of equipment has no direct relationship with the balancing of systems as defined above. The use of such a flow regulator can be regarded as a palliative to insufficient calculation by replacing a relatively simple static balancing means with a regulating unit containing moving parts, purely in order to avoid the initial regulating operation using one of the procedures indicated above. The use of these flow regulators is limited because, on the one hand, its field of application is restricted owing to incompatibility with thermostatic radiator valves, and on the other hand because it represents a greater investment cost than conventional solutions.

Figure 2:
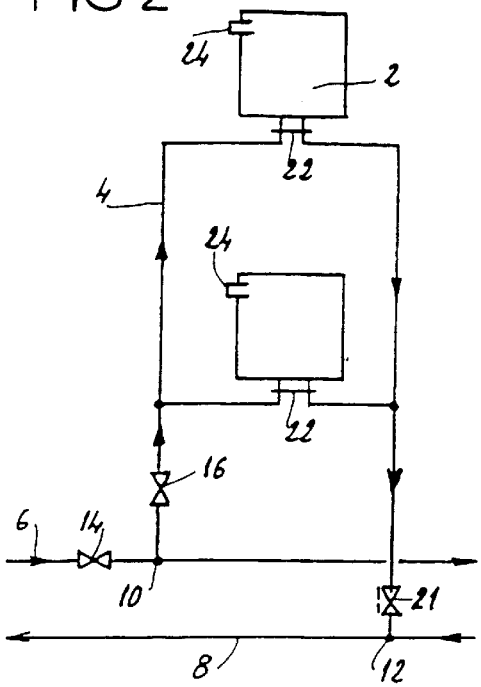

FIGS. 1 and 2 each show a circuit branched off from a heating system equipped with balancing means. In both of these figures, radiators 2 are supplied with heat-transfer fluid via pipes 4. FIG. 1 shows radiators 2 equipped with conventional valves while in FIG. 2 the radiators 2 are equipped with integrated valves. FIGS. 1 and 2 both show a main flow pipe 6 and a main return pipe 8. The branch circuit is connected at a branch point 10 to the main flow pipe 6 and at a branch point 12 to the main return pipe 8. Upstream of the branch point 10 supplying the branch circuit is a balancing valve 14. Downstream of this branch point 10 there is generally an isolating valve 16 which plays no particular part in the balancing of the circuit. At the tail end of each branch circuit is another balancing valve 21. The latter is adjustable and is used to adjust the loss of head of the branch circuit.

In FIG. 1, each radiator 2 is provided upstream of its supply with a thermostatic radiator valve 18 and upstream [sic] with a lockshield valve 20. The thermostatic radiator valve 18 is for thermostatic regulation of the temperature of the room where the radiator 2 is installed, while the lockshield valve 20 is for balancing the system.

In FIG. 2, in the case of radiators 2 with integrated valves, a hydraulic module 22 supplies a radiator 2 and each radiator 2 is fitted with a thermostatic radiator valve 24. As a rule, the housing of the thermostatic radiator valve 24 also contains a lockshield valve. We thus have a hydraulic module 22 allowing heat-transfer fluid to be supplied to the radiator 2, a thermostatic radiator valve for thermostatic regulation, and a lockshield valve (not labeled) alongside the thermostatic radiator valve for balancing the system.

When balancing these circuits (FIGS. 1 and 2) the problems discussed above are encountered.

Document EP-0 677 708 describes the principle of a hot-water heating system comprising several radiators connected together by at least one line. These radiators each have a valve for controlling the flow of fluid through the radiator. In order to ensure favorable conditions of circulation, the valves connected to the radiators are differential pressure control valves equipped preferably with a device for adjusting the set-point value. No concrete embodiment of such a device is disclosed in that document.

It is therefore an object of the present invention to provide an automatic balancing device in order to solve the balancing problems currently encountered with existing balancing means.

To this end, the device proposed is a liquid-based heat-transfer system-balancing device for a heating, air-conditioning or similar system, comprising a first calibrated or adjustable orifice and, situated downstream of the first orifice, a second orifice, wherein the opening of the second orifice is controlled by a poppet valve whose position is controlled by means for moving the poppet valve as a function of the pressure difference between the upstream and downstream sides of the first orifice.

According to the invention, this device is located in two separate bodies connected to each other, a first body corresponding to the first orifice and a second body corresponding to the second orifice.

In a first embodiment, the means for moving the poppet valve as a function of the pressure difference across the first orifice comprise a diaphragm separating a housing into two chambers, one chamber being in communication with the upstream side of the first orifice and the other chamber being in communication with the downstream side of this first orifice. In this form, a compensating spring acting on the diaphragm is advantageously provided.

The balancing device according to the invention preferably also comprises means for bringing about a movement as a function of the temperature of the room in which the device is located, these means acting on the opening and closing of either the first or the second orifice.

The means for bringing about a movement as a function of the temperature of the room in which the device is situated advantageously comprise a thermostatic head of the type used in a thermostatic radiator valve.

In one advantageous embodiment, the means for bringing about a movement as a function of the temperature of the room in which the device is located act on a second poppet valve situated at the first orifice.

In a preferred embodiment, the first body comprises the first orifice, a poppet valve controlling the opening and closing of this orifice, and a thermostatic head acting on the poppet valve, and the second body comprises a diaphragm calibrated if necessary by a spring and integral with a poppet valve which acts on the second orifice formed inside this second body.

In this preferred embodiment, one side of the diaphragm is advantageously connected to the first body via a pipe length or the like and the other side of the diaphragm is advantageously connected to the first body by a radiator.

In the case of a heating circuit with centralized distribution, one side of the diaphragm is for example connected to the first body via a line or the like and the other side of the diaphragm is for example connected to the first body by a radiator and a line.

The present invention also relates to a hydraulic module for supplying heat-transfer fluid to a heat emitter, such as a radiator, and collecting the fluid as it leaves the heat emitter, characterized in that it comprises one of the bodies of a balancing device as described above. Such a module is more especially designed for a radiator with integrated valves. This module takes the flow and return pipes of the heat-transfer fluid, and, via flexible hoses forming a device generally known as a harness, sends the heat-transfer fluid to the radiator inlet and collects the heat-transfer fluid as it leaves the radiator.

In a hydraulic module according to the invention, the balancing device may be situated upstream or downstream of the heat emitter.

The invention also relates to a radiator characterized in that it is equipped with a balancing device according to the invention or with a hydraulic module as described above.

In such a radiator, the automatic balancing device with which it is equipped is situated hydraulically either upstream or downstream of the radiator.

However, a clear understanding of the invention will be gained from the following description, with reference to the appended schematic drawing, showing by way of non-limiting examples a number of embodiments of a device for automatically balancing a liquid-based heat-transfer system according to the invention.

Figure 3:
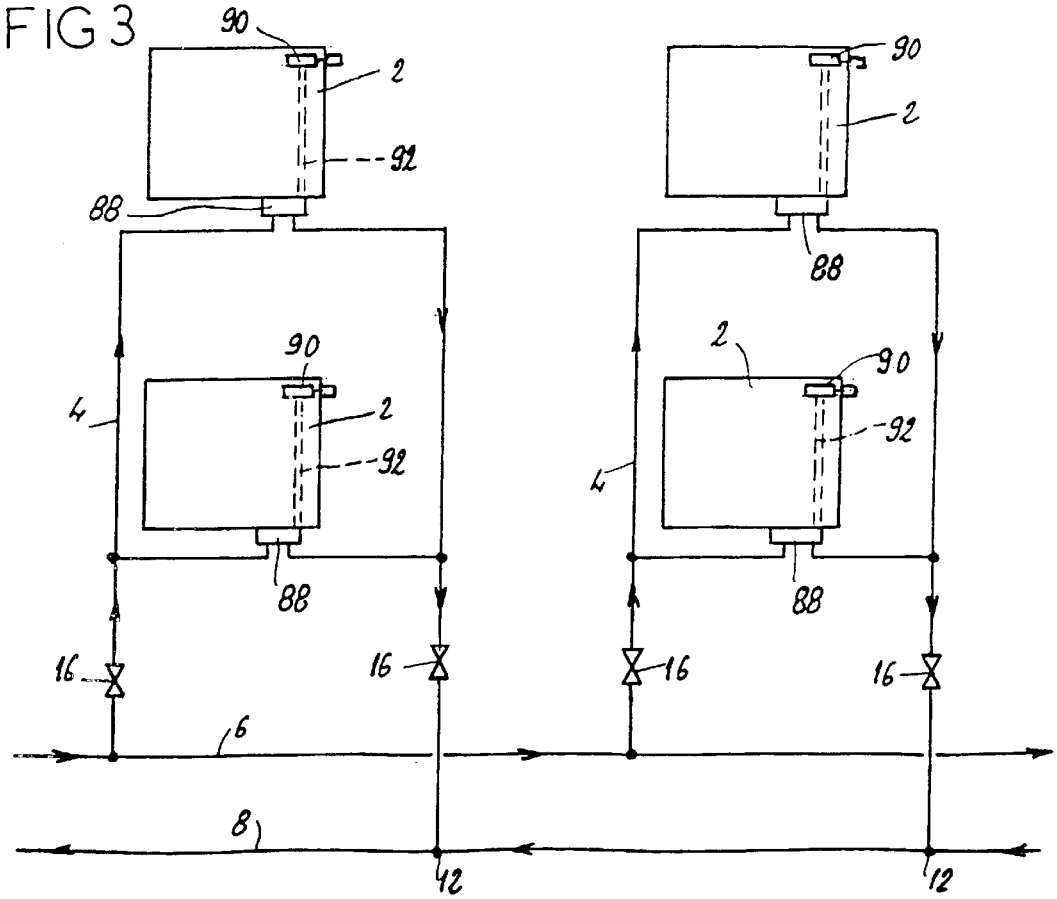
Figure 5:
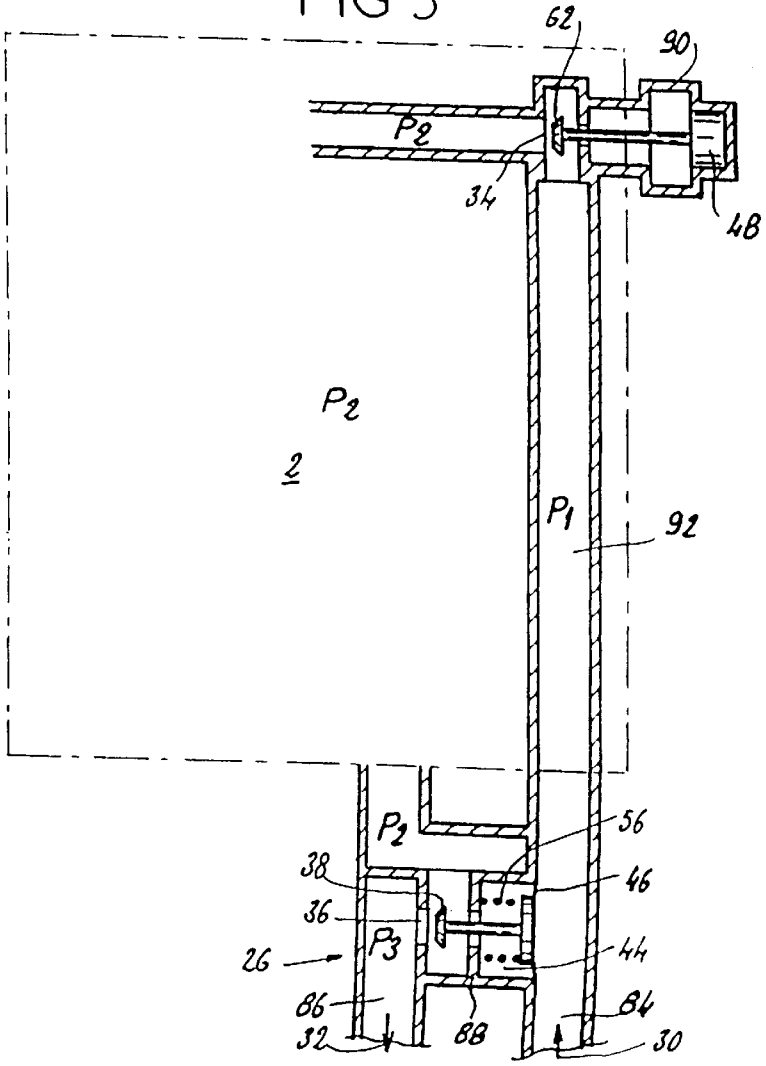
Figure 4:
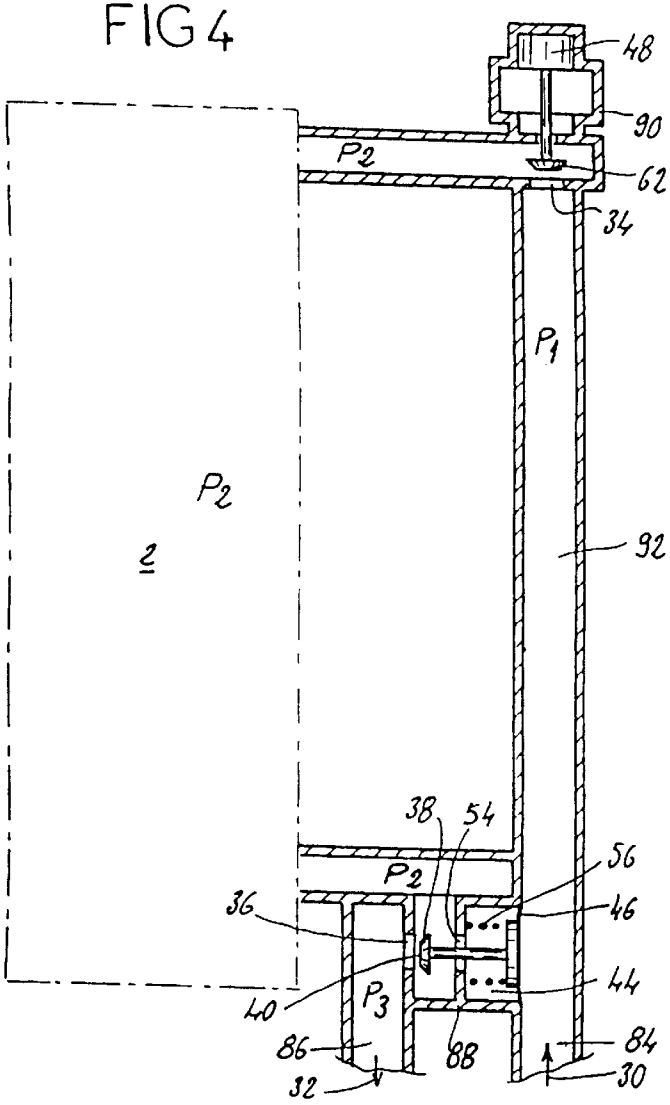
Figure 6:
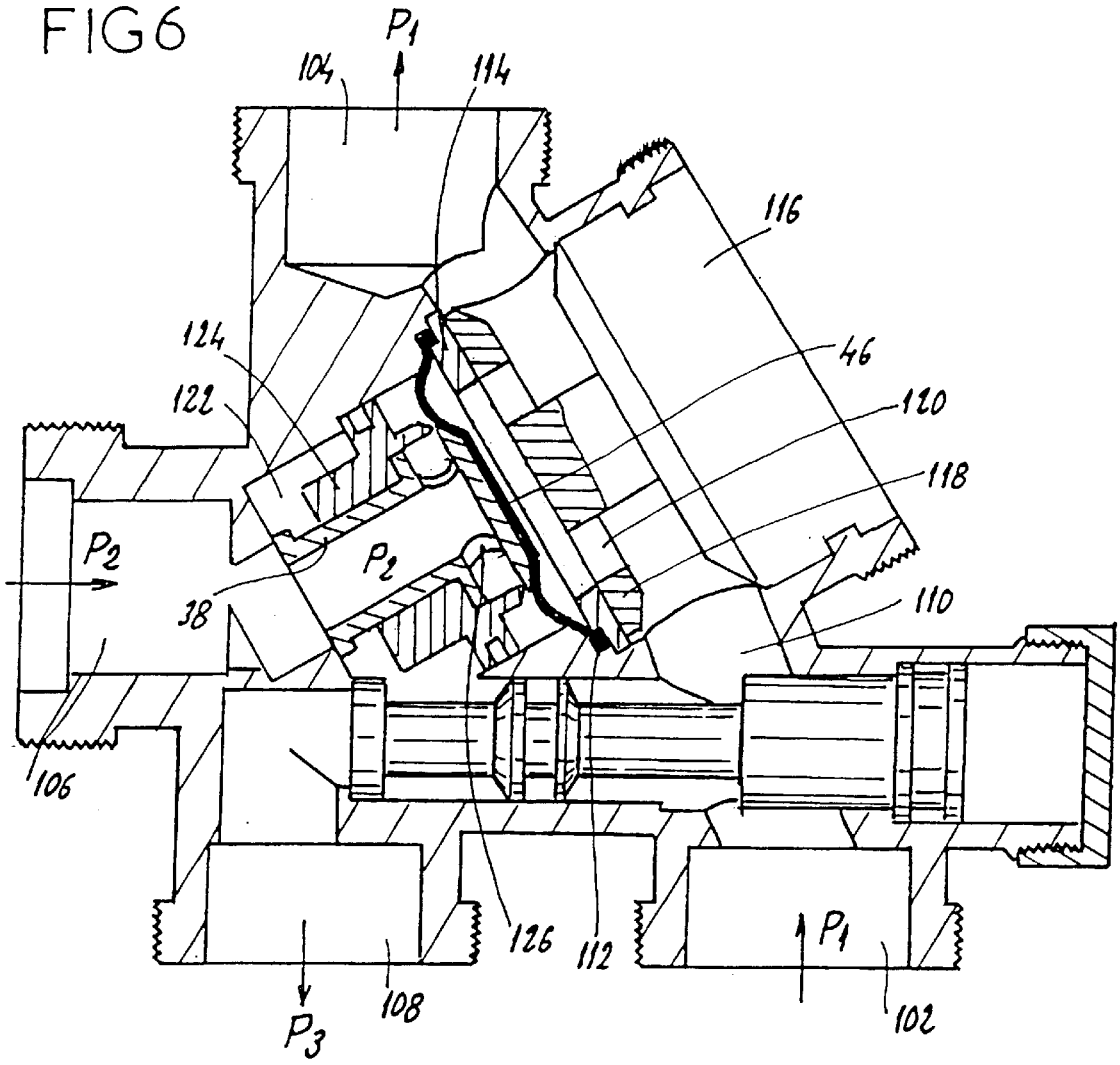
Figure 7:
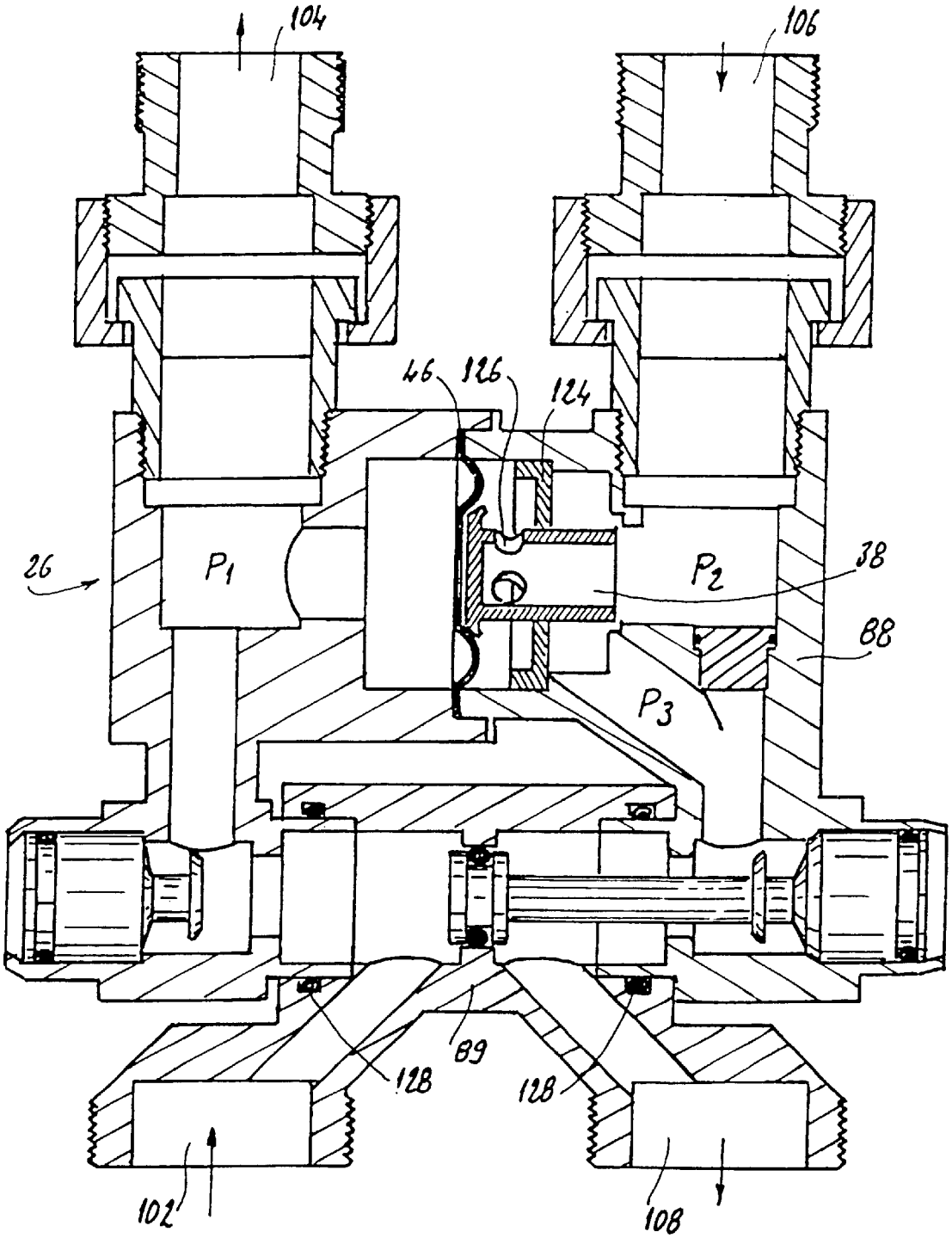
Figure 8:
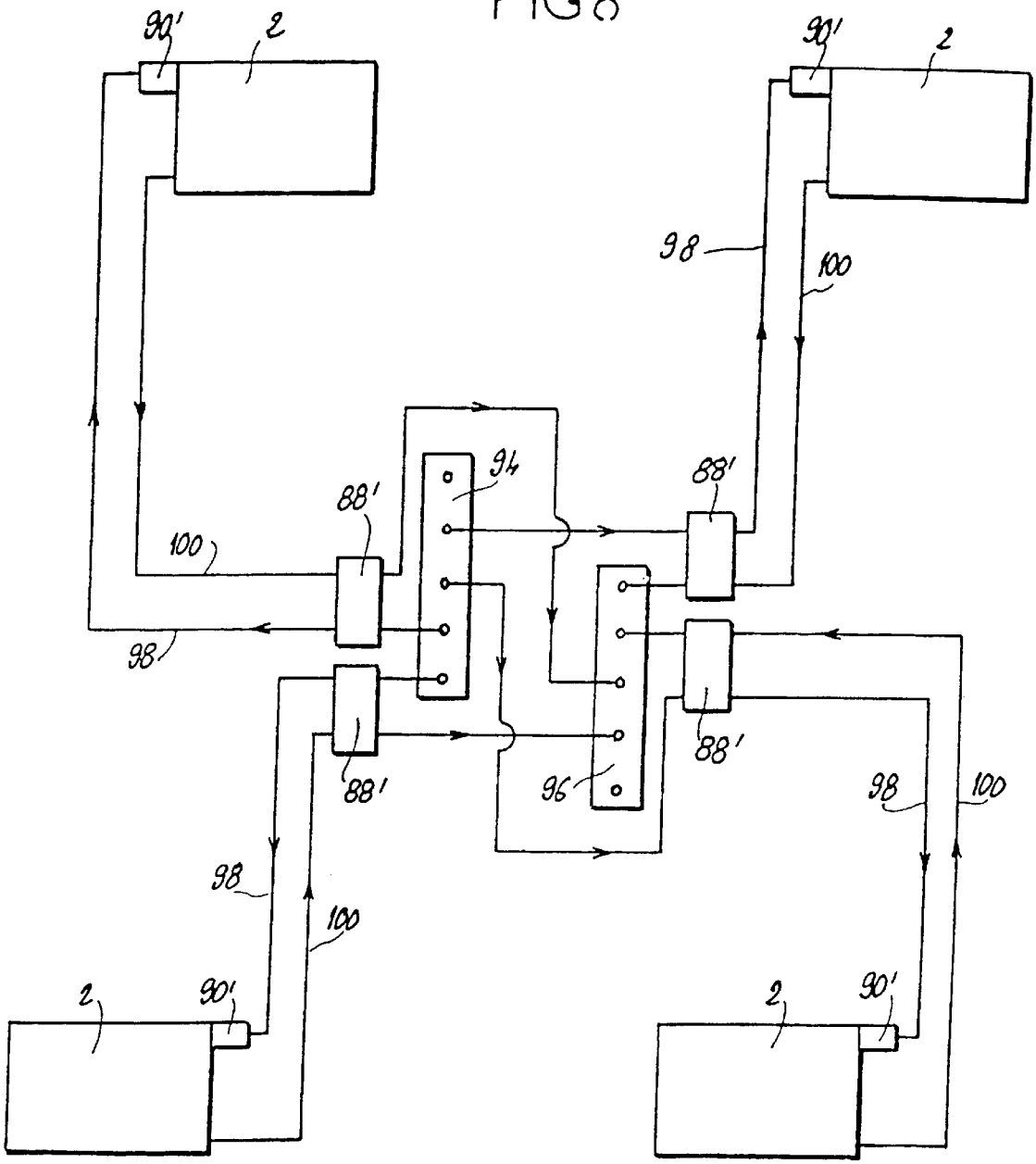
Figure 9:
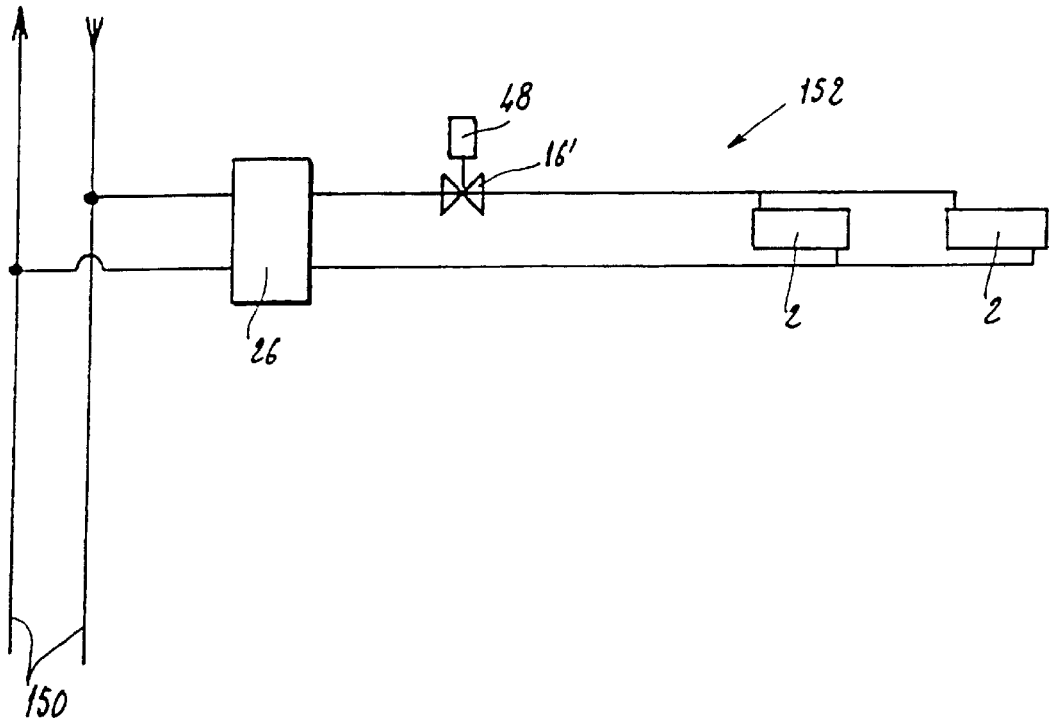

FIGS. 1 and 2 show branch circuits of a heating system equipped with balancing means of the prior art, FIG. 3 shows two branch circuits fitted with balancing means according to the invention, FIG. 4 shows a radiator equipped with an independent flow-control module and a balancing device in a first embodiment, FIG. 5 shows a radiator with an integrated flow-control module fitted with the balancing device of FIG. 4, FIG. 6 is an enlarged sectional view through a distributor that can be used on a radiator as shown in FIG. 4, FIG. 7 is an enlarged sectional view through a module that can be used on a radiator as shown in FIG. 5, FIG. 8 shows a heating circuit with centralized distribution equipped with balancing devices according to the invention, and FIG. 9 shows part of an individual centralized heating circuit equipped with a balancing device according to the invention.

FIGS. 1 and 2 have already been described in the preamble of this patent application. FIG. 3 shows two branch circuits of a heating circuit. As with the branch circuits of FIGS. 1 and 2, there is a main flow pipe 6 and a main return pipe 8. Each branch circuit also includes two radiators 2 connected in parallel. Both of these are radiators with integrated valves. However, the invention can also be applied to radiators with conventional valves. These radiators 2 are fed with heat-transfer fluid via pipes 4. A hydraulic module 26 allows a radiator 2 to be fed with heat-transfer fluid. It incorporates a central heating-balancing device according to the invention.

Each branch circuit also includes at the beginning and end an isolating valve 16. It is therefore possible totally to isolate a branch circuit hydraulically from the rest of the heating circuit. This is sometimes necessary when working for example on one radiator.

FIG. 4 shows schematically and in section a first embodiment of a central heating-balancing means according to the invention. This means comprises a fluid inlet 30 corresponding to a flow pipe 84 and a fluid outlet 32 corresponding to a return pipe 86.

Between the inlet 30 and the outlet 32, the device has a first adjustable orifice 34 and a second orifice 36 with a poppet valve 38 to regulate its opening and closing.

The poppet valve 38 comprises a head 40 and a stem 42. The head 40 is designed to open and close the second orifice 36. Its shape is adapted to the shape of a seat formed in the second orifice 36. The stem of the poppet valve 42 passes through a chamber 44 in a first body 88 of the balancing device which is closed by a diaphragm 46.

The body 88 contains the flow-regulating seat 36, the corresponding poppet valve 38, the diaphragm 46 and a compensating spring 56. One side of the diaphragm, the side not facing the chamber 44, is subject to the pressure in the flow pipe 84. The flow-regulating seat 36, by contrast, is formed between the return of the fluid from the radiator 2 and the return pipe 86.

At the first orifice 34, when the heat-transfer fluid passes through the central heating-balancing device according to the invention, a loss of head occurs, taking the form of a pressure drop. There is thus a fluid pressure P1 before the orifice 34, and a pressure P2 after this first orifice 34. The inequality is P1>P2. One side of the diaphragm 46 is subject to the pressure P1. In FIG. 4, it is the right-hand side of the diaphragm 46 which is subject to the pressure P1. This right-hand side is the side turned away from the valve head 40. The other side of the diaphragm 46 is subject to the pressure P2. The chamber 44 is in communication with the region located downstream of the adjustment orifice 34, that is the interior of the radiator 2, via a passage 54 for the poppet valve stem 42. The diaphragm 46 therefore comes under the pressure P1 on one side and under the pressure P2 on the other. In order to prevent the diaphragm 46 always being deformed toward the side where the pressure is lower, the compensating spring 56 is positioned on the lower-pressure side. This spring 56 surrounds the poppet valve stem 42. It pushes at one end on the diaphragm 46 and at the other on the body 88 around the passage 54. The diaphragm 46 is thus in a central position for a given pressure difference P1-P2 and its position varies when the pressure difference P1-P2 varies.

Downstream of the second orifice 36 is a pressure P3, itself less than the pressure P2 because of the pressure drop (loss of head) occasioned by the second orifice 36 and the associated poppet valve 38.

The losses of head created by the radiator 2 and the pipe length 92 are small, not to say negligible, compared with the loss of head between the upstream and downstream sides of the first orifice 34.

A second poppet valve 62, associated with the first orifice 34, controls the opening of the latter. This poppet valve 62 is controlled by a thermostatic head 48. The thermostatic head 48, the poppet valve 62 and the first orifice 34 are mounted in a second body 90 connected to the body 88 by a pipe length 92, which continues the flow pipe 84. The poppet valve 62 controls the passage of fluid leaving this length of pipe and entering the radiator 2.

The operation of the device will now be described. It is assumed that heat-transfer fluid is sent to the inlet 30 by, for example, a pump (not shown).

If the temperature in the room does not vary and the set point given to the thermostatic head 48 is not modified, the device according to the invention works like a flow regulator. Thus, if the pressure P1 rises, the flow through the device will tend to rise. However, this pressure P1 is transmitted to the right-hand side of the diaphragm 46. This diaphragm will therefore tend, under the effect of a greater pressure P1, to move toward the left (referring to FIGS. 4 and 5). This movement of the diaphragm tends to close the second orifice 36 by means of the poppet valve 38. As a result, the flow through the device according to the invention is reduced. The flow increase created by the rise in the pressure P1 is therefore countered by the flow decrease caused by the closing of the poppet valve 38.

Now, in a situation in which the pressures remain substantially constant and the temperature in the room or the temperature set point changes, the thermostatic head 48 will act on the poppet valve 62. This will then modify the opening of the first orifice 34. If the temperature rises, the poppet valve 62 will tend to close the first orifice 34, thus causing a reduction in the rate of flow of heat-transfer fluid. On the other hand, if the temperature drops, the thermostatic head will act on the poppet valve 62 to open the orifice 34. The rate of flow of heat-transfer fluid through the balancing device according to the invention will thus increase. The increased amount of heat-transfer fluid now passing through the radiator 2 will heat the room back to the set-point temperature imposed on the thermostatic head 48.

When the temperature varies, or when the temperature set-point varies, the action of the second poppet valve 62 modifies the pressure drop at the orifice 34, and this in turn has an action on the first poppet valve 38.

Thus, for constant temperature and set-point temperature, if P1 increases, the flowrate will tend to increase, but the variation in P1 also acts on the diaphragm 46 and the poppet valve 38 to tend to close this valve. The flow is thus regulated.

For constant pressure but variable temperature or set-point temperature, the thermostatic head 48 acts on the second poppet valve 62. If the temperature rises, the poppet valve 62 opens and the pressure P1 remains constant while P2 increases. The first poppet valve 38 therefore also opens, allowing a larger flow. If on the other hand the temperature falls, the poppet valve 62 closes, the pressure P1 remains constant, the pressure P2 reduces and the poppet valve 38 also closes. The flow through the device is reduced.

The fluid could also be circulated from the left to the right in FIGS. 4 and 5, against the directions of the arrows shown in these figures. The compensating spring 56 would simply have to be placed on the other side of the diaphragm 46 to that shown in FIGS. 4 and 5, so that this spring 56 is on the side of the membrane exposed to the lower pressure. Operation would then remain identical. It is then preferable in this case to describe the first orifice 34 as the thermostatic seat and the second orifice 36 as the flow-regulating seat.

In FIGS. 4 and 5, the balancing device is identical, but in one case a body 88 is placed in a hydraulic module 26 independent of the radiator 2 (FIG. 4) and in the other case a body 88 is placed in a module 26 integrated into the radiator 2 (FIG. 5).

FIG. 6 shows another embodiment of a body 88 designed to be fitted to a radiator, while being independent of this radiator.

Here, the body 88 is essentially triangular in shape. In the heart of this triangle is the diaphragm 46 and the poppet valve 38 with which it is associated. This poppet valve is shown here in the closed position.

The body 88 has a first inlet 102 which corresponds to the fluid inlet 30 in FIG. 4, a first fluid outlet 104 which corresponds to the outlet toward the pipe length 92, a second inlet 106 which corresponds to the return from the radiator 2 to the body 88, and a second outlet 108 which corresponds to the outlet 32. A passage 110 connects the inlet 102 directly with the outlet 104. One side of the diaphragm 46 faces this passage 110. The outer edge of the diaphragm 46 rests on a shoulder 112. This edge is retained by a ring 114 which itself is retained in the body by a plug 116. An opening has been made in the body 88 in alignment with the diaphragm 46 to allow the insertion of the poppet valve 38 and the diaphragm 46, and the plug 116 then closes this opening. With this plug 116 is a bearing disk 118 containing orifices 120 so that that side of the diaphragm 46 which is adjacent to the passage 110 is subject to the pressure of the fluid passing through this passage 110.

The poppet valve 38 is placed in a housing 122 that also contains a guide part 124 for the valve 38. The latter is for example bonded to the diaphragm 46. It is tubular in shape and a longitudinal section through this poppet valve shows it to be T-shaped. The base of the T is oriented toward the second inlet 106. The pressure inside the poppet valve 38 is thus the pressure P2 which is also present inside the radiator 2. In order that this pressure P2 is also exerted on the other side of the diaphragm 46, i.e. the face not adjacent to the passage 110, the part of the poppet valve next to the diaphragm 46 includes openings connecting the interior of the poppet valve 38 to the exterior. Movement from the second inlet 106 to the second outlet 108 is controlled by the poppet valve 38.

FIG. 7 shows an embodiment of a hydraulic module corresponding to the module shown in FIG. 5. Here the body 88 is generally H-shaped. The central bar of the H contains the diaphragm 46 and the poppet valve 38. Just as in the embodiment shown in FIG. 6, this form has a first inlet 102, a first outlet 104, a second inlet 106 and a second outlet 108. The poppet valve 38 is once again a tubular valve with openings 126 near the diaphragm 46. It is similarly guided in a guide part 124. Essentially the same characteristics as those explained with reference to FIG. 6 are present here again, with a different overall shape of the body 88.

The difference here is that the body is made in two parts that can pivot with respect to each other. One part is labeled 88 while the other part carries the label 89. The part 89 contains the first inlet 102 and the second outlet 108 and is connected to the central heating system while the first part 88 is connected by the first outlet 104 and the second inlet 106 to the radiator 2. The part 89 includes a basically horizontal tubular portion from which extend two tubular legs containing the first inlet 102 and the second outlet 108. The basically horizontal tubular portion forms the pivot axis of the body 88 on the second part 89. To enable the two parts 88 and 89 to be joined together, the body 88 is made in two portions. The join between these two portions occurs at the diaphragm 46. Thus, this diaphragm is sandwiched between the two portions of the body 88. A fixing flange and screws are provided to fix these two portions of the body 88 together. These flanges and screws are not shown in the drawing. The diaphragm 46 acts as a gasket between the two component parts of the body 88. O-rings 128 are provided as seals between the second body 89 and the body 88.

Constructing the module 26 in several parts has the advantage of adaptability to almost all assembly situations. Whatever the relative orientations of the water inlet pipes and radiator branch pipes, the module 26 can be adapted to the situation.

FIG. 8 shows a variant for a device according to the invention. Whereas the embodiment shown in FIGS. 4 and 5 is adapted to a heating circuit in which distribution occurs along two tubes (two-tube distribution) and the radiators are connected in parallel between these two tubes, or in which distribution occurs along one tube (one-tube distribution) and the radiators are connected in series to the tube, the embodiment shown in FIG. 8 is adapted to a centralized or octopus distribution.

FIG. 8 is a schematic showing a circuit with four radiators 2. The heat-transfer fluid is distributed by two manifolds. One manifold 94 receives the heat-transfer fluid from a boiler or other source and distributes it to the radiators 2. The second manifold 96 collects the heat-transfer fluid after it has passed through the radiators 2. Four lines 98 run from the first manifold 94, each connecting it to one radiator 2, while four other lines 100 each connect one radiator 2 to the second manifold 96.

As can be seen in FIG. 8, modules 88' are positioned near the manifolds 94 and 96. These modules are identical to the bodies 88 in FIGS. 4 and 5. The poppet valve, the diaphragm and the spring contained in the modules 88' have not therefore been shown, exactly the same configuration being found inside the modules 88' as in the bodies 88. At each radiator 2 is a box 90' identical to the bodies 90 in FIGS. 4 and 5. The insides of the boxes 90' have not been shown for the same reasons.

The losses of head between the modules 88' and the bodies 90' are greater than between the bodies 88 and 90. However, as this loss of head is more or less constant, it does not prevent flow regulation and thermal regulation. It will be observed that if a body 88 calibrated to regulate a given flow in a configuration corresponding to FIG. 4 or 5 is used in a layout as shown in FIG. 8, the regulated flow will be less because of the loss of head.

A module 26 as shown in FIGS. 6 and 7 can also be adapted to an individual centralized heating circuit. In a heating circuit of this kind there is a primary loop, of which two tube sections 150 are shown in FIG. 9. A secondary loop 152 is connected to this primary loop and in the present example feeds two radiators 2 in parallel. The module 26 is connected between the secondary loop and the primary loop. Downstream of the hydraulic module 26, on the secondary module 152, is a control valve 16' for feeding or cutting off the secondary loop 152. A thermostatic head 48 is positioned close to this valve 16'. The hydraulic module 26 associated with the valve 16' and with the thermostatic head 48 thus acts as a balancing device according to the invention.

In a heating system, when each heat emitter of the system is fitted with a system-balancing device according to the invention, system balancing and thermostatic regulation occur automatically. As regards system balancing, the devices according to the invention will maintain the chosen flowrate at the given set-point values. More precisely, each device according to the invention will maintain the flowrate between upper and lower limit values defined by its proportional band.

After installation, all that is required is to regulate the internal temperature set point so that the device according to the invention is operational. This device is therefore intended to replace the traditional thermostatic radiator valve by adding to it an additional function, that of balancing the central heating system.

In order to adjust radiators using prior-art balancing means, a temperature drop is imposed on the heat-transfer fluid between the inlet and the outlet of the heat emitter. This temperature drop is used to calculate the necessary flowrate for the heat-transfer fluid through the heat emitter.

With a system-balancing device according to the invention, the adjustment of a radiator is performed in a different way. Specifically, the rate of flow through the heat emitter is controlled and the result is a variable temperature drop between the inlet and the outlet of the radiator. Care is of course taken to produce temperature drops within an acceptable range, such as for example an interval of from 5 to 20° C.

The device according to the invention makes the actions of flow regulation and temperature regulation compatible with each other, which is not the case with existing equipment: the preamble of this patent application explains why, in the prior art, flow regulators are incompatible with a heating system equipped with thermostatic radiator valves. By combining these two elements, the flow controller and the thermostatic radiator valve, in a novel way, the invention simultaneously provides automatic balancing of the central heating system and thermostatic regulation.

It goes without saying that the invention is not limited to the embodiments shown schematically in the drawing; on the contrary, it encompasses all variants within the scope of the claims given below.

For example, the displacement of the poppet valve or poppet valves is controlled by a diaphragm and/or a thermostatic head. It is perfectly possible for the poppet valve(s) to be acted upon by an electronically controlled electric motor. It is thus conceivable to measure the pressure difference on either side of the first orifice of the device according to the invention and to have a temperature probe measuring the room temperature. These measurements are then converted into electrical signals and, after processing by an electronic unit, a control signal is sent to an electric motor controlling the position of the corresponding poppet valve in order to determine its opening.

A central heating system-balancing device according to the invention can be built into a hydraulic module which is itself built into a radiator. It can also be located on a radiator in which the valves are not integrated. This device could for example be mounted in the position of the thermostatic radiator valve on a conventional radiator.

The diagram, FIG. 3, showing part of a heating circuit is provided purely as a guide. A heating circuit of any other configuration can also be equipped with central heating system-balancing devices according to the invention.

Another possibility would be to have a device that did not use a thermostatic radiator valve. An orifice creating a loss of head is sufficient. It may be a predetermined orifice, an adjustable orifice, a valve for example, or an orifice controlled electrically in response to various parameters.

If a thermostatic head is used, or other means capable of bringing about a displacement in response to the temperature, these means may be connected in series with the means acting in response to the pressure difference. The means for bringing about a displacement in response to the temperature could then for example act on the diaphragm described in the illustrative embodiments described above.

What is claimed is:

1. Hydraulic module for supplying heat-transfer fluid to a heat emitter, such as a radiator, and collecting the fluid as it leaves the heat emitter, and forming a device for balancing a liquid-based heat-transfer system, characterized in that it comprises:

two fluid inlets and two fluid outlets, a first inlet (30) being designed for connection to the fluid supply of the system and forming the inlet of a first circuit internal to the module (26), the outlet of which is the outlet of the module designed to supply the heat emitter (2), and the second inlet being designed for the return of the fluid from the heat emitter and forming the inlet of a second circuit internal to the module, the outlet (32) of which is the outlet of the module designed for the return of the fluid to the supply system, and a diaphragm (46), a poppet valve (38) that is equipped with a head (40) and with a means (42) of connection to the diaphragm (46) and is designed to control the opening of an orifice (36) in the second circuit in order to regulate the flow through the latter, the diaphragm (46) separating the two circuits and therefore being subject on each side to their respective pressures.

2. Module according to claim 1, characterized in that a compensating spring (56) acts on the diaphragm (46).

3. Module according to claim 1, characterized in that it also comprises means for bringing about a movement as a function of the temperature of the room in which the device is located, these means acting on the opening and closing of the orifice (36).

4. Module according to claim 3, characterized in that the means for bringing about a movement as a function of the temperature comprise a thermostatic head (48), of the type used in a thermostatic radiator valve.

5. Module according to claim 3, characterized in that the means (48) for bringing about a movement as a function of the temperature of the room in which the device is located act on a second poppet valve (62) situated at the first orifice (34), situated between the first outlet of the module and the inlet of the heat emitter.

6. Module according to claim 1, characterized in that it comprises a first body (90, 90') that comprises a first orifice (34), a poppet valve (62) controlling the opening and closing of this orifice, and a thermostatic head (48) acting on a poppet valve (62), and a second body (88, 88') that comprises a diaphragm (46) calibrated if necessary by a spring (56) and integral with a poppet valve (38) acting on a second orifice (36) formed inside this second body (88, 88').

7. Module according to claim 6, characterized in that one side of the diaphragm (46) is connected to the first body (90) via a pipe length (92) or the like and in that the other side of the diaphragm (46) is connected to the first body (90) by a radiator (2).

8. Module according to claim 7, characterized in that one side of the diaphragm (46) is connected to the first body (90') via a line (98) or the like and in that the other side of the diaphragm (46) is connected to the first body (90') by a radiator (2) and a line (100).

9. Radiator (2), characterized in that it is equipped with a hydraulic module (26) according to claim 1.

10. Radiator (2) according to claim 9, characterized in that the hydraulic module is built into the radiator.

11. Module according to claim 2, characterized in that it also comprises means for bringing about a movement as a function of the temperature of the room in which the device is located, these means acting on the opening and closing of the orifice (36).

12. Module according to claim 4, characterized in that the means (48) for bringing about a movement as a function of the temperature of the room in which the device is located act on a second poppet valve (62) situated at the first orifice (34), situated between the first outlet of the module and the inlet of the heat emitter.

13. Radiator (2), characterized in that it is equipped with a hydraulic module (26) according to claim 2.

14. Radiator (2), characterized in that it is equipped with a hydraulic module (26) according to claim 3.

15. Radiator (2), characterized in that it is equipped with a hydraulic module (26) according to claim 4.

16. Radiator (2), characterized in that it is equipped with a hydraulic module (26) according to claim 5.

17. Radiator (2), characterized in that it is equipped with a hydraulic module (26) according to claim 6.

18. Radiator (2), characterized in that it is equipped with a hydraulic module (26) according to claim 7.

19. Radiator (2), characterized in that it is equipped with a hydraulic module (26) according to claim 8.

* * * * *